US007536024B2

(12) United States Patent
Bailey et al.

(10) Patent No.: US 7,536,024 B2
(45) Date of Patent: May 19, 2009

(54) LOUDSPEAKER

(75) Inventors: Daniel Bailey, London (GB); Graeme Foy, London (GB)

(73) Assignee: Mordaunt-Short Ltd., London (GB)

( * ) Notice: Subject to any disclaimer, the term of this patent is extended or adjusted under 35 U.S.C. 154(b) by 650 days.

(21) Appl. No.: 11/128,718

(22) Filed: May 13, 2005

(65) Prior Publication Data

US 2005/0254681 A1 Nov. 17, 2005

(30) Foreign Application Priority Data

May 17, 2004 (GB) ..... 0410962.5

(51) Int. Cl.
*H04R 1/20* (2006.01)

(52) U.S. Cl. ..... 381/338; 381/337; 381/349

(58) Field of Classification Search ..... 381/337, 381/338, 349, 339–343
See application file for complete search history.

(56) References Cited

U.S. PATENT DOCUMENTS

| | | | | | |
|---|---|---|---|---|---|
| 1,969,704 | A | * | 8/1934 | Alton | 181/160 |
| 2,225,312 | A | | 12/1940 | Mason | |
| 2,228,886 | A | * | 1/1941 | Olson | 181/158 |
| 2,262,146 | A | * | 11/1941 | Massa | 381/338 |
| 2,789,651 | A | * | 4/1957 | Daniels | 381/338 |
| 2,880,817 | A | * | 4/1959 | Burns et al. | 181/156 |
| 4,421,957 | A | * | 12/1983 | Wallace, Jr. | 381/338 |
| 5,111,509 | A | * | 5/1992 | Takeuchi et al. | 381/338 |
| 5,479,420 | A | | 12/1995 | Hong et al. | |
| 5,479,520 | A | | 12/1995 | Nieuwendijk et al. | |
| 5,524,062 | A | * | 6/1996 | Oh | 381/338 |
| 6,021,208 | A | * | 2/2000 | Kin-Lung | 381/338 |
| 7,130,438 | B2 | * | 10/2006 | Lin | 381/337 |
| 2004/0022405 | A1 | * | 2/2004 | Caron et al. | 381/337 |

FOREIGN PATENT DOCUMENTS

| | | | |
|---|---|---|---|
| DE | 3126130 | A1 | 1/1983 |
| EP | 0 589 515 | B1 | 1/1999 |
| GB | 626623 | | 7/1949 |
| GB | 752 651 | A | 7/1956 |
| GB | 752651 | | 7/1956 |
| GB | 2 290 672 | A | 3/1996 |
| GB | 2 380 091 | A | 3/2003 |
| JP | 2202298 | A | 8/1990 |
| JP | 02 246699 | A | 10/1990 |
| JP | 11205887 | A | 7/1999 |
| JP | 11220787 | A | 8/1999 |
| WO | WO 01/10168 | | 2/2001 |

OTHER PUBLICATIONS

European Search Report dated Jun. 19, 2006 (2 pages).
GB Search Report for Application No. GB0509868.6, dated Aug. 3, 2005, 2 pages.

* cited by examiner

*Primary Examiner*—Curtis Kuntz
*Assistant Examiner*—Jesse A Elbin
(74) *Attorney, Agent, or Firm*—TraskBritt

(57) ABSTRACT

A loudspeaker comprising a loudspeaker drive unit being operable to radiate sound in a forward direction and a rearward direction and an enclosure configured to receive sound radiated in the rearward direction. The enclosure comprises a passageway system comprising a plurality of parts of different lengths. Each of the different length parts has an opening, whereby rearward radiated sound induces standing wave resonances of air in the different length parts at different fundamental frequencies.

18 Claims, 4 Drawing Sheets

SECTION A-A

LOUDSPEAKER

BACKGROUND OF THE INVENTION

1. Field of the Invention

The present invention relates to a loudspeaker, particularly but not exclusively a loudspeaker configured to reproduce high frequency audio signals (e.g., a tweeter for use in a multi-way loudspeaker system).

2. State of the Art

Loudspeaker systems comprising open-backed drive units which radiate sound in both a forward and rearward direction are well known in the art. Such drive units may comprise a voice coil coupled to the rear of a diaphragm and a magnet assembly for interacting with the voice coil to move the diaphragm. The magnet assembly may have an aperture for allowing sound radiated from the rear of the diaphragm to pass through the magnet assembly.

Sound waves radiated from the rear of an open-backed drive unit may be out of phase with those emitted from the front of the drive unit. Accordingly, care must be taken to take account of interference between sound radiated in a rearward direction (hereinafter "rearward radiation") and sound radiated in a forward direction (hereinafter "forward radiation"). One common solution is to house the rear of each drive unit in an enclosure or baffle (e.g., cabinet) in order to isolate or in some way modify the rearward radiation to prevent undesirable interference. However, the presence of an enclosure at the rear of a drive unit will generally result in a mismatch in the acoustic impedance presented to the front and the rear of the drive unit. Unless the enclosure is carefully designed, this mismatch can have a highly detrimental effect on sound quality.

Various arrangements have been proposed in the art to minimize the detrimental effects of the mismatch in forward and rearward acoustic impedance. For example, open-backed drive units for use as tweeters have been developed where the magnet assembly comprises a short tubular enclosure for receiving rearward radiating sound. However, such an enclosure will generally have a large resonant peak at a frequency related to the dimensions of the tube.

BRIEF SUMMARY OF THE INVENTION

The present applicant has identified the need for an improved loudspeaker which overcomes, or at least alleviates, some of the disadvantages associated with prior art designs.

In accordance with the present invention, there is provided a loudspeaker comprising a loudspeaker drive unit being operable to radiate sound in a forward direction and a rearward direction and an enclosure configured to receive sound radiated in the rearward direction, wherein the enclosure comprises a passageway system comprising a plurality of parts of different lengths, each with an opening, whereby rearward radiated sound induces standing wave resonances of air in different length parts at different fundamental frequencies.

By encouraging standing wave resonance (or "pipe resonance") at a plurality of different fundamental frequencies, the overall acoustic impedance presented to the rear of the drive unit may be controlled. For example, the overall rear acoustic impedance may be configured to have a flatter impedance response than can normally be achieved with a single length of tube. For example, the passageway system may be configured to provide resonance peaks (e.g., fundamental resonance peaks and harmonics) substantially spanning at least one octave. The fundamental frequencies of the passageway system may be chosen such that the resonant peaks (including harmonics) overlap to some degree. If carefully chosen, the resulting superposition of peaks may provide a surprisingly flat acoustic impedance (in comparison to a single length of tube) which may offer improved sonic performance and present a more even load to an amplifier driving the loudspeaker.

The different length parts of the passageway system may have fundamental frequencies spanning just less than one octave. The passageway system may be tuned to match the frequency range of the driver (e.g., front bandwidth). The passageway system may additionally be tuned to a higher or lower frequency depending on the desired addition to the overall response in-room.

In one embodiment, the passageway system may comprise one continuous passageway with the plurality of parts arranged in series therealong. For example, the passageway system may comprise one tortuous passageway comprising a series of straights of different lengths connected by sharp turns. Vents may be located at the end of each straight to allow rearwardly radiated sound to escape the enclosure. In this way, sound may be radiated from the vents along the tortuous passageway.

In another embodiment, the passageway system may comprise a plurality of discrete passageways of different lengths (e.g., arranged in parallel). The opening to each passageway may face a rear part of the drive unit. The opening of each passageway may be contiguous with or immediately adjacent one or more apertures in the drive unit. For example, if the drive unit comprises an annular magnet assembly (e.g., open ring yoke) having a central aperture for allowing rearward radiation to pass therethrough, the opening of each passageway may be immediately adjacent the aperture. In another version, the magnet assembly may comprise a plurality of apertures, each forming the opening to a respective passageway.

Any volume presented to rearward radiating sound before it reaches the passageways will tend to alter the acoustic impedance characteristics of the enclosure. Thus, it may be desirable to minimize spacing between the drive unit and the openings to the passageways.

The cross-sectional area of the opening of each part of the passageway system may be substantially smaller than the cross-sectional area of a diaphragm of the drive unit. For example, the cross-sectional area of each opening may be less than a tenth of the cross-sectional area of the diaphragm. The total cross-sectional area of the openings may be less than half the cross-sectional area of the diaphragm. The cross-sectional areas of the openings of each part may be substantially identical.

The passageway system may comprise at least four parts (e.g., straights or discrete passageways) of different length. In other arrangements, the passageway system may comprise at least ten parts of different length.

In the embodiment with the plurality of discrete passageways, each passageway may be elongate (e.g., tubular). Each passageway may be tapered, perhaps with passageway cross-section decreasing with distance from the drive unit. Each passageway may be arranged to extend substantially parallel to a drive axis of the drive unit, with each passageway opening facing the rear of the drive unit (e.g., facing the diaphragm). In this way, it is believed that unwanted early reflections from the passageways may be minimized. The passageways may be closely packed to maximize the number of passageways coupled to the drive unit.

In one embodiment, each discrete passageway may be closed or sealed at its end furthest from the drive unit. In this way, a loudspeaker may be provided having a sealed enclosure (or "infinite baffle").

In another embodiment, each discrete passageway may have an opening at its end furthest from the drive unit (hereinafter "exit end"), allowing rearwardly radiated sound to pass through the passageways and escape the enclosure. To avoid or at least alleviate interference effects, the exit apertures, which may also be termed exit end openings, may be configured to radiate sound in an incoherent fashion. For example, the exit apertures or exit end openings may be located at different positions on a periphery of the enclosure so that different frequencies of rear radiation are emitted in slightly different directions. In this way, energy may be released from the rear of the loudspeaker in such a way as to add more favorably to the diffuse field radiation in a room than plane wave radiation, and may interact with room structures in a more favorable way. The exit apertures or exit end openings of the passageways may be axially offset and/or radially offset (e.g., relative to the drive unit axis).

The enclosure may comprise a tapered body portion (e.g., a substantially conical or frustoconical portion) into which the discrete passageways extend, with the cross-sectional area of the tapered body portion decreasing with increasing distance from the drive unit. The tapered body portion may have a central axis which is substantially co-axial with the drive unit axis. The discrete passageways may be located at different radial distances from the central axis.

In the case of an enclosure comprising a plurality of exit end openings, the exit end openings may be spaced both axially and radially with respect to the central axis. For example, the exit aperture or exit end openings may be formed in a spiral pattern (e.g., along points on a logarithmic spiral) with passageways of shorter length (with exit apertures or exit end openings closer to the drive unit) being located at a larger radial distance from the central axis than passageways of longer length.

DESCRIPTION OF THE DRAWINGS

An embodiment of the present invention will now be described by way of example with reference to the accompanying drawings in which.

DETAILED DESCRIPTION OF THE INVENTION

Figure 1:
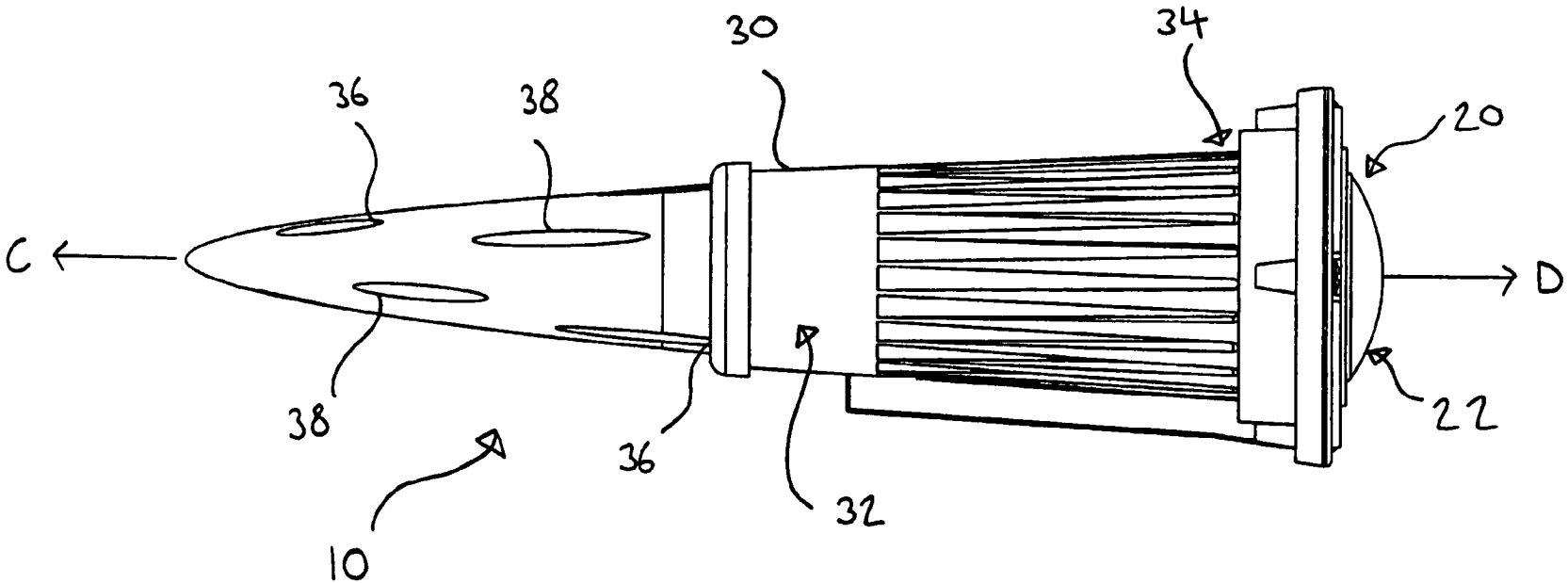
FIG. 1 shows a schematic side view of a loudspeaker embodying the present invention.
Figure 2A:
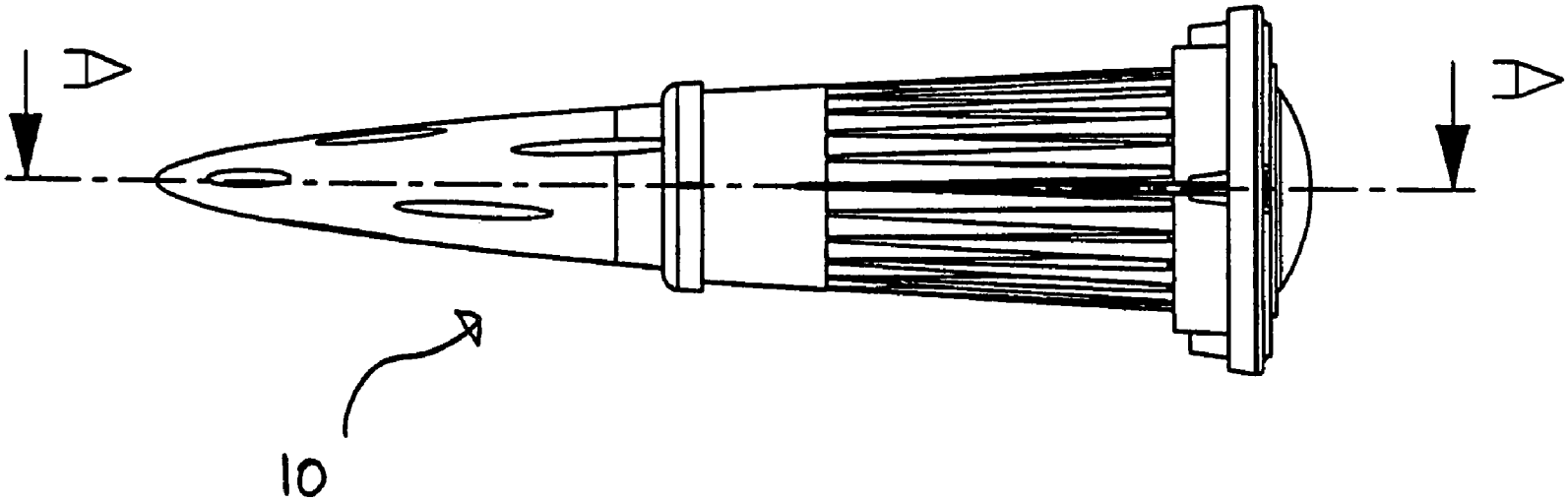
FIG. 2A shows a schematic underside view of the loudspeaker shown in FIG. 1.
Figure 2B:
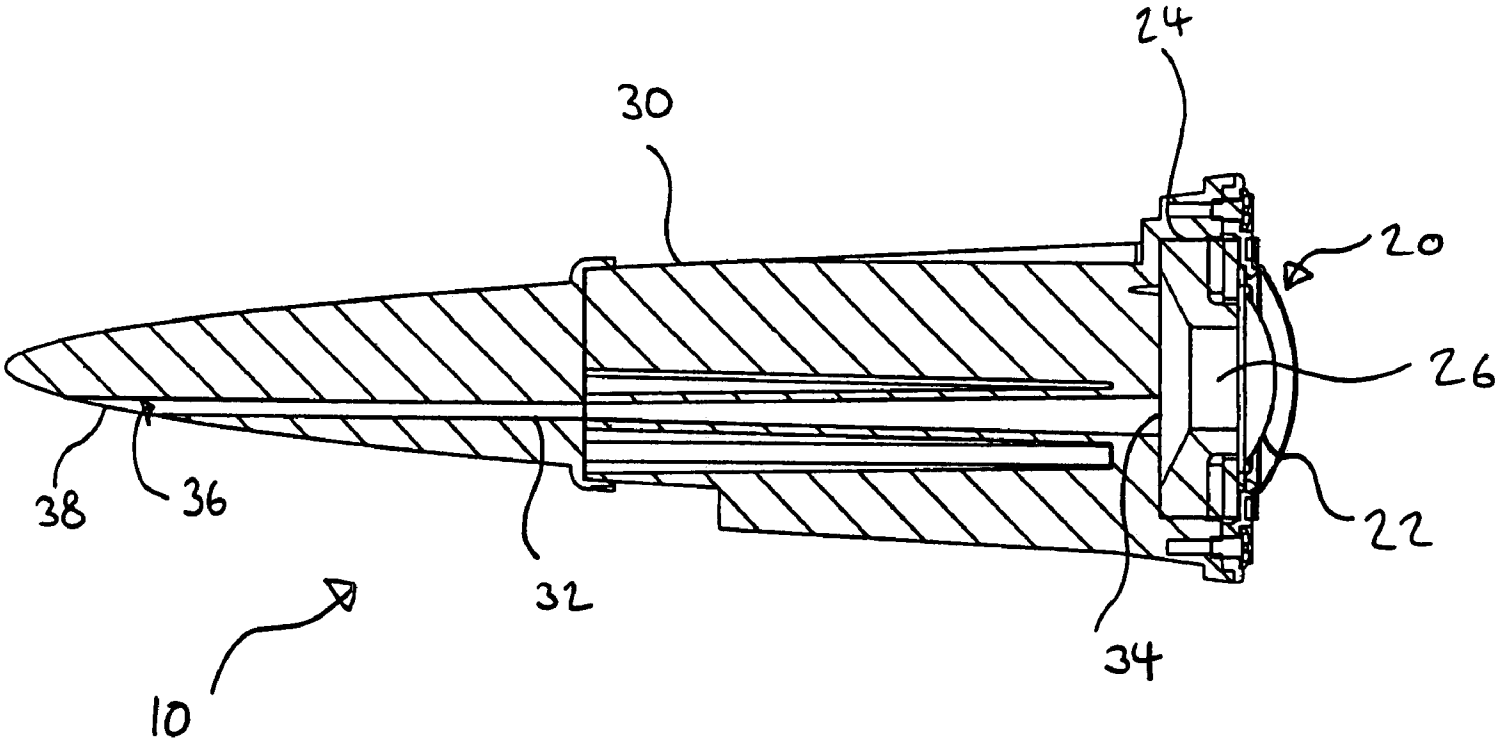
FIG. 2B shows a cross-sectional view of the loudspeaker shown in FIG. 1 through section A-A.
Figure 2C:
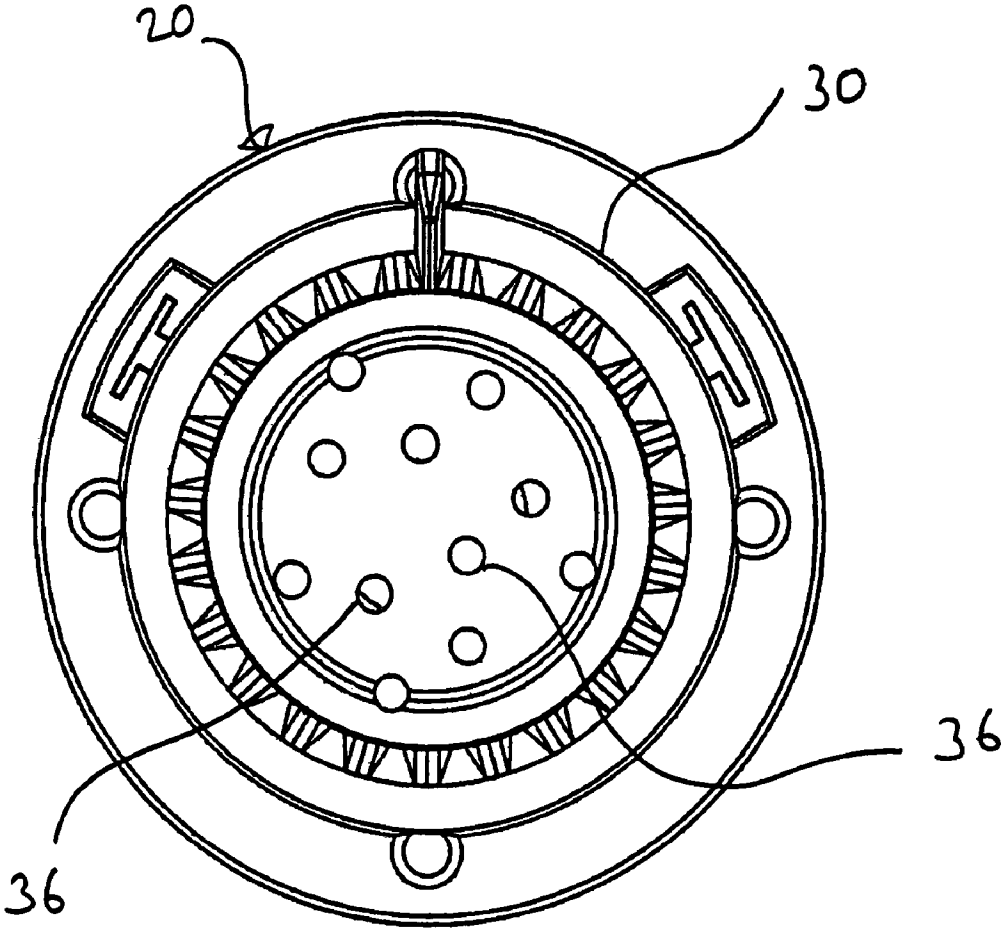
FIG. 2C shows a schematic rear view of the loudspeaker shown in FIG. 1.

FIGS. 1, 2A, 2B and 2C show a loudspeaker 10 intended for use as a tweeter in a multi-way loudspeaker system. However, the present invention may also be applied to loudspeakers configured to reproduce audio signals over other frequency ranges (e.g., full-range drivers, mid-range drivers and even bass drivers).

Loudspeaker 10 includes a drive unit 20 defining a drive axis D and a substantially conical enclosure 30 defining a (co-axial) central axis C. Drive unit 20 comprises a dome-shaped diaphragm 22 and an open ring magnet assembly 24 (see FIG. 2B). In use, diaphragm 22 reciprocates backwards and forwards along the drive axis D. Sound radiated in a forward direction proceeds directly into the loudspeaker's surrounding environment (e.g., listener's room); sound radiated in a rearward direction passes through a central aperture 26 in the magnet assembly 24 and is received by enclosure 30. Enclosure 30 is attached to the drive unit 20 to form a rigid unit. The loudspeaker 10 may be mounted in or on a cabinet housing.

Enclosure 30 comprises a plurality of tubes or passageways 32 of different lengths, each with an opening 34 immediately adjacent a central aperture 26 (FIG. 2B) in the magnet assembly 24. The number of tubes 32 and tube geometries (e.g., tube length and tube diameter) may be chosen to suit the intended frequency response of the drive unit 20. In the embodiment shown, the enclosure 30 has eleven tubes 32, each of different length, and the openings 34 to the tubes 32 have substantially equal cross-section. However, the relative cross-sectional areas of the openings 34 may be altered to tune the enclosure 30 (e.g., to increase or decrease the contribution made by any particular tube).

Each of the tubes 32 runs substantially parallel to the drive axis D (e.g., within an angle of no more than 15° from the drive axis D). At the end of each tube 32 is an exit end opening 36 for allowing rearwardly radiated sound to escape the enclosure 30 and add to the sound radiated from the front of the drive unit 20. In order to encourage sound to be radiated in an incoherent fashion, the exit end openings 36 are spaced both axially and radially with respect to the central axis C. In the embodiment shown, the exit apertures or exit end openings 36 are formed in a spiral pattern (along points on a logarithmic spiral) with tubes of shorter length (with exit apertures or exit end openings closer to the drive unit) being located at a larger radial distance from the central axis C than passageways of longer length. As shown, the difference in length between adjacent pairs of passageways along the logarithmic spiral increases with decreasing spacing from the central axis C.

The substantially conical enclosure 30 may be formed in two parts, the first comprising plastic material and the second comprising metal. At least a portion of each tube 32 is tapered in the first part of the enclosure 30, with its largest cross-sectional area being spaced therefrom. At least a portion of each tube 32 in the second part of the enclosure 30 may be of constant cross-section. As shown, the enclosure 30 has flared grooves 38 located at each exit aperture or exit end opening 36 to encourage dispersion of sound radiated therefrom.

What is claimed is:

1. A tweeter for use in a multi-way loudspeaker system, comprising a tweeter drive unit being operable to radiate sound in a forward direction and a rearward direction and an enclosure configured to receive sound radiated in the rearward direction, wherein the enclosure comprises a passageway system comprising a plurality of discrete passageways of different lengths, each with an opening for receiving rearward radiated sound from the tweeter drive unit and an exit end opening at its end furthest from the tweeter drive unit, whereby rearward radiated sound induces standing wave resonances of air in different length passageways at different fundamental frequencies.

2. The tweeter according to claim 1, wherein the fundamental frequencies of the passageway system are chosen such that resonant peaks produced by standing wave resonance of air in the different length parts overlap to some degree.

3. The tweeter according claim 1, wherein the different length parts of the passageway system produce a range of standing waves having fundamental frequencies spanning substantially one octave.

4. The tweeter according to claim 1, wherein each passageway is elongate.

5. The tweeter according to claim 4, wherein each passageway is arranged to extend substantially parallel to a drive axis of the tweeter drive unit, with each passageway opening facing the rear of the tweeter drive unit.

6. The tweeter according to claim 1, wherein the exit end openings are located at different positions on a periphery of the enclosure so that different frequencies of rear radiation are emitted in different directions.

7. The tweeter according to claim 6, wherein the exit end openings are spaced both axially and radially with respect to a central axis of the enclosure.

8. The tweeter according to claim 7, wherein passageways of shorter length, with exit end openings closer to the tweeter drive unit, are located at a larger radial distance from the central axis of the enclosure than passageways of longer length.

9. The tweeter according to claim 8, wherein the enclosure is conical or frustoconical and substantially centered about the central axis.

10. The tweeter according to claim 9, wherein each exit end opening comprises a flared groove in an exterior surface of the enclosure.

11. The tweeter according to claim 1, wherein the exit end openings extend to and open on an exterior surface of the enclosure.

12. The tweeter according to claim 1, wherein a first portion of each passageway is tapered, with a largest cross-sectional area proximate the tweeter drive unit, and a second portion of each passageway is of constant cross-section.

13. A tweeter comprising a tweeter drive unit operable to radiate sound in a forward direction and a rearward direction and a substantially conical or frustoconical enclosure configured to receive sound radiated in the rearward direction, wherein the enclosure comprises a central axis substantially concentric with the tweeter drive unit and a passageway system comprising a plurality of discrete passageways of different lengths disposed at mutually differing radii about the central axis, each passageway having an opening for receiving rearward radiated sound from the drive unit and an exit end opening at its end furtherest from the tweeter drive unit proximate a surface of the enclosure, wherein a length of each passageway determines a radial position thereof such that a passageway of a given length lies at a greater radius from the central axis than any longer passageway.

14. The tweeter of claim 13, wherein the plurality of discrete passageways are arranged in a spiral pattern about the central axis.

15. The tweeter of claim 14, wherein the spiral pattern comprises points on a logarithmic spiral.

16. The tweeter according to claim 13, wherein the exit end openings extend to and open on an exterior surface of the enclosure.

17. The tweeter according to claim 13, wherein each exit end opening comprises a flared groove in an exterior surface of the enclosure.

18. The tweeter according to claim 13, wherein a first portion of each passageway is tapered, with a largest cross-sectional area proximate the tweeter drive unit, and a second portion of each passageway is of constant cross-section.

* * * * *